US005991589A

United States Patent [19]

Thompson et al.

[11] Patent Number: 5,991,589

[45] Date of Patent: Nov. 23, 1999

[54] SYSTEM FOR CHARGING TONER ON A TONER CARRYING MEMBER FOR REMOVING TONER FROM THE TONER CARRYING MEMBER

[75] Inventors: John A. Thompson; George B. Clifton, both of Boise, Id.

[73] Assignee: Hewlett-Packard Company, Palo Alto, Calif.

[21] Appl. No.: 08/889,112

[22] Filed: Jul. 7, 1997

[51] Int. Cl.[6] ..... G03G 15/01

[52] U.S. Cl. ..... 399/297; 399/302

[58] Field of Search ..... 399/101, 297, 399/302, 308, 296

[56] References Cited

U.S. PATENT DOCUMENTS

| | | | |
|---|---|---|---|
| 4,701,042 | 10/1987 | Mimura et al. | 399/296 |
| 5,079,597 | 1/1992 | Mauer et al. | 399/302 |
| 5,371,579 | 12/1994 | Bisaiji | 399/296 |
| 5,512,986 | 4/1996 | Toyomura et al. | 399/308 |
| 5,722,015 | 2/1998 | Tombs | 399/101 X |
| 5,732,310 | 3/1998 | Hiroshima et al. | 399/101 |
| 5,752,130 | 5/1998 | Tanaka et al. | 399/101 |

*Primary Examiner*—William Royer
*Attorney, Agent, or Firm*—Gregg W. Wisdom

[57] ABSTRACT

In a color electrophotographic printing system using a transfer belt, residual toner remains on the surface of the transfer belt after the printing of a page. To prevent print defects from occurring, the residual toner on the surface of the transfer belt must be removed. A transfer belt charge roller driven by a high voltage power supply is used to positively charge the residual toner to permit electrostatic transfer of the residual toner from the surface of the transfer belt to the surface of a photoconductor drum for removal by a cleaning blade. By applying an AC waveform and a positive DC offset, the residual toner is effectively positively charged for electrostatic removal from the transfer belt.

17 Claims, 4 Drawing Sheets

SYSTEM FOR CHARGING TONER ON A TONER CARRYING MEMBER FOR REMOVING TONER FROM THE TONER CARRYING MEMBER

FIELD OF THE INVENTION

The present invention relates generally to electrophotographic imaging systems, and, more specifically to a toner charging system used in the electrostatic removal of residual toner.

BACKGROUND OF THE INVENTION

In some types of electrophotographic imaging processes, such as in a color electrophotographic printer, a transfer belt or transfer drum is used to accumulate the toner developed on the photoconductor prior to the transfer to the print media. This intermediate operation may be performed, for example, in a color electrophotographic printer which successively develops each color plane of an image onto the photoconductor drum and then transfers each developed color plane of the image onto a transfer belt. After the image is accumulated onto the transfer belt, the image is transferred onto the print media.

However, the process of transferring the image from the transfer belt to the print media is usually not complete. Residual toner which does not transfer to the print media must be substantially removed to prevent print quality defects from subsequently occurring. Attempts have been made to charge the residual toner in such a way that the residual toner can be electrostatically moved from the transfer belt back to the photoconductor. Residual toner which has been returned to the photoconductor can be removed by a cleaning blade. Previous attempts to remove the residual toner by mechanical or electrostatic means have not been sufficiently effective. A need exists for an apparatus which will properly charge residual toner to permit electrostatic removal from the surface carrying the residual toner.

SUMMARY OF THE INVENTION

To meet this need, a toner charging system was developed to charge the residual toner. The toner charging device effectively charges the residual toner to a polarity which allows for the electrostatic removal of the residual toner. The toner charging system includes a member to carry the toner, such as a transfer belt or transfer drum. The toner charging system also includes a charging device, such as a charge roller or other contact charging device, to charge the residual toner. A power supply coupled to the charging device supplies a signal, such as a voltage waveform or a current waveform, having an AC component and a DC component. The inclusion of an AC component in the signal permits uniform charging of the toner to the polarity necessary for electrostatic removal without accumulation of the residual toner on the charging device.

DESCRIPTION OF THE DRAWINGS

A more thorough understanding of the invention may be had from the consideration of the following detailed description taken in conjunction with the accompanying drawings in which.

DETAILED DESCRIPTION OF THE INVENTION

The present invention is not limited to the specific exemplary embodiments illustrated herein. Although an embodiment of the toner charging system will be discussed in the context of a color electrophotographic printer, one of ordinary skill in the art will recognize by understanding this specification that the toner charging system has applicability in both color and monochrome electrophotographic image forming systems.

Figure 1:
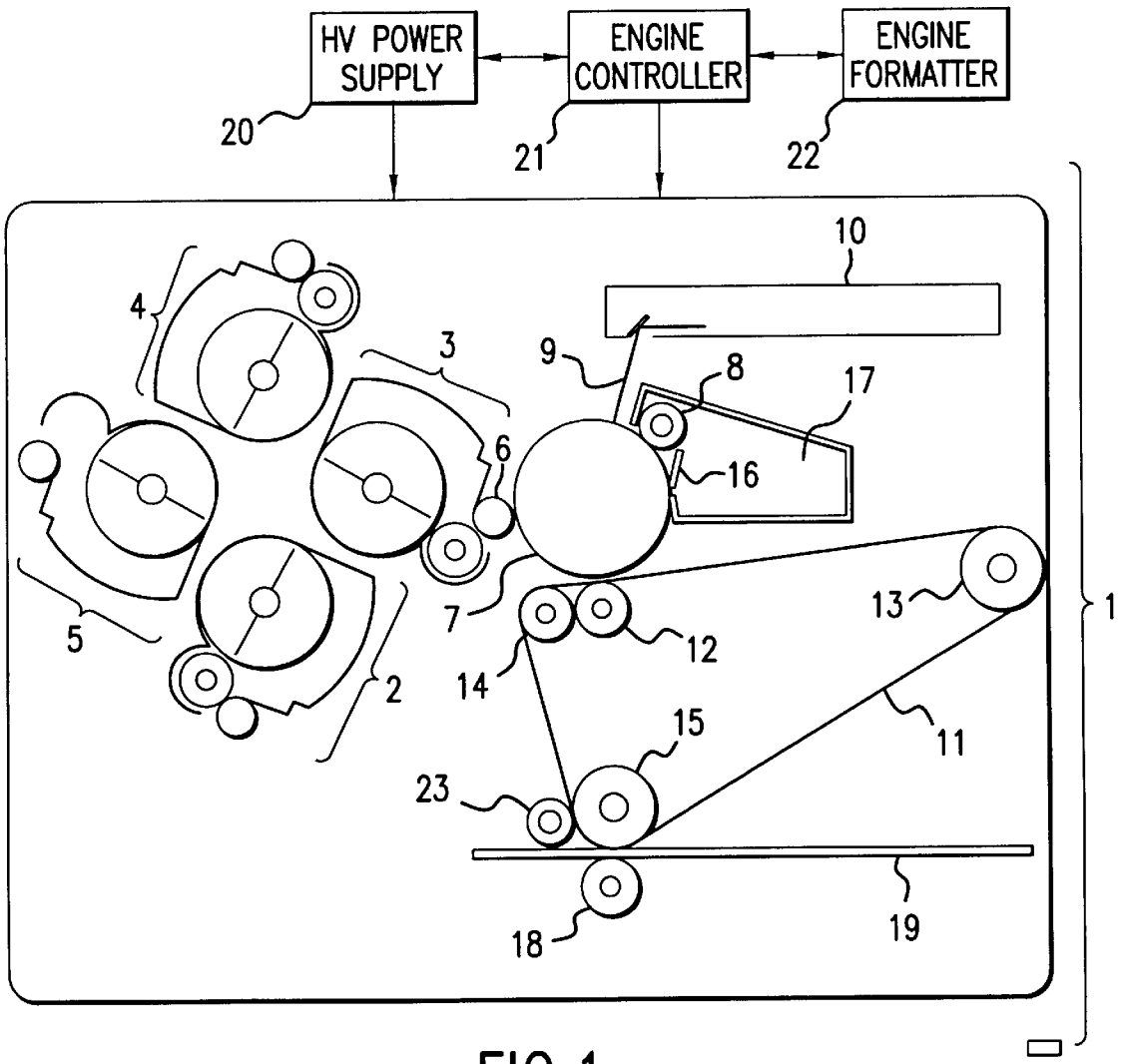
FIG. 1 is a schematic representation of a color electrophotographic printer containing an exemplary embodiment of the toner charging system.

Shown in FIG. 1 is a simplified schematic representation of a color electrophotographic printing system 1. The exemplary electrophotographic printing system 1 uses three colored toners, cyan, magenta, and yellow and a black toner for accomplishing color printing. The cyan developer 2, magenta developer 3, yellow developer 4, and black developer 5 are mounted on a developer carousel (not shown in FIG. 1) which rotates the developer from which toner will be taken to the appropriate position. The function of the developer carousel is indicated by the relative positions of the cyan 2, magenta 3, yellow 4, and black 5 developers.

The electrophotographic printing system 1 forms the printed image by successively printing each of the four color planes. For the purposes of illustrating the operation of electrophotographic printing system 1, first consider the printing of the magenta color plane. In this case, the developer carousel will have rotated the magenta developer 3 into position so that the magenta developer roller 6 is positioned opposite photoconductor drum 7. The developer carousel is located so that when the developers 2–5 are rotated into position, a tightly controlled first gap exists between the surface of developer roller 6 (or any of the other developer rollers so located) and the surface of photoconductor drum 7. This first gap is optimized for the movement of toner across it in response to an applied electric field.

A charging device, such as photoconductor charge roller 8, deposits a negative charge on the surface of photoconductor drum 7. A laser beam 9 emitted by laser scanner 10 is pulsed as it is swept across the surface of the photoconductor drum 7. Laser scanner 10 typically uses a rotating multi-faceted rotating mirror to sweep laser beam 9 across the surface of photoconductor drum 7. The pulsing of laser beam 9 is controlled so that the areas of the photoconductor drum 7 onto which magenta toner will be developed are discharged by laser beam 9 as the photoconductor drum 7 rotates in the counter-clockwise direction. The discharged areas on the surface of photoconductor drum 7 rotate so that they are located opposite the surface of developer roller 6. As the discharged areas on the surface of photoconductor drum 7 most closely approach the surface of developer roller 6, magenta toner located on the surface of developer roller 6 is projected onto the discharged areas of photoconductor drum 7.

Each of the toners acquires a negative charge through tribo-electric charging which occurs within the toner reservoirs of the cyan 2, magenta 3, yellow 4, and black 5 developers. An electrical signal applied to developer roller 6 creates an electric field which provides the force to project magenta toner from the surface of developer roller 6 onto discharged areas of photoconductor drum 7. The electrical signal includes a negative DC offset voltage with a superimposed AC waveform.

Electrophotographic printing system 1 uses a toner carrying member, such as transfer belt 11, to collect the toner from each developed color plane. The location around the circumference of photoconductor drum 7 which most closely approaches the surface of transfer belt 11 facing photoconductor drum 7 defines a second gap. The surface of the photoconductor drum 7, now electrostatically holding magenta toner developed onto the discharged areas, rotates in the counter clockwise direction toward the second gap. A first transfer roller 12, located in contact with a surface of transfer belt 11 opposite the second gap is biased with a positive voltage to positively charge the surface of transfer belt 11 with which it is in contact. In response to the electric field formed between the surface of the photoconductor drum 7 and the first transfer roller 12, toner moves from the surface of the photoconductor drum 7 to the surface of the transfer belt 11 as the transfer belt 11 moves in a clockwise direction. First backup roller 14 and second backup roller 15 are also positively biased to assist in the transfer of toner from the transfer belt 11 at a later stage of the printing process. A grooved roller 13 drives the transfer belt 11. This process continues until the transfer belt 11 contains, over its surface, the magenta component of the page which is to be printed. This process is replicated for the cyan 2, the yellow 4, and the black 5 developers. The transfer process from photoconductor drum 7 onto transfer belt 11 is not accomplished with 100% efficiency. Toner remaining on photoconductor drum 7 which does not transfer is removed by cleaning blade 16 and deposited in waste hopper 17.

When all four color planes of the image to be printed have been developed onto photoconductor drum 7 and transferred to transfer belt 11, a second transfer process is used to transfer the developed image present on the surface of transfer belt 11 to print media 19. Transfer belt 11 is located in close proximity to a second transfer roller 18 so that a third gap is formed. Print media 19, which previously has entered the print media path of electrophotographic printing system 1, passes between transfer belt 11 and second transfer roller 18 in this third gap so that the print media 19 contacts the transfer belt 11 and the second transfer roller 18. The second transfer roller positively charges the surface of print media 19 with which it is in contact. As the print media 19 passes between transfer belt 11 and second transfer roller 1 8, the electric field formed by the positively charged print media 19 pulls toner from the transfer belt 11 onto the print media 19. Subsequent to the transfer of toner from transfer belt 11 to the print media 19, the print media 19 passes through a fuser assembly (not shown) which fixes the toner to the print media. The arrival of the leading edge of print media 19 at the third gap is timed so that it corresponds to the top of the printed page on the transfer belt 11.

A high voltage power supply 20 supplies the voltages and currents to the various charge rollers, transfer rollers, developer rollers, and coronas necessary for operation of the electrophotographic processes. The photoconductor charge roller 8 is driven with an AC waveform, such as a sinusoid, having a negative D.C. offset. The amplitude and frequency of the AC waveform are selected so that the surface of photoconductor drum 7 on which charge will be deposited is uniformly charged at approximately the value of the D.C. offset. The transfer rollers are driven with positive DC voltage during the transfer operation and a negative DC voltage during cleaning cycles. The developer rollers are driven with an AC waveform, such as a sinusoid or a square wave, having a variable negative D.C. offset.

Engine controller 21 provides the necessary control signals at the appropriate times to high voltage power supply 20 to accomplish printing on print media 19 using the electrophotographic process of electrophotographic printing system 1. In addition engine controller 21 sends a stream of binary print data to laser scanner 10 to control the pulsing of laser beam 9 for formation of the latent electrostatic image on the surface of photoconductor drum 7. Engine formatter 22 receives a print data stream from the host system (not shown) and forms the raster print data stream from this print data stream. The rasterized print data stream is sent to engine controller 21 for conversion to a format suitable for controlling the pulsing of laser beam 9.

Figure 2:
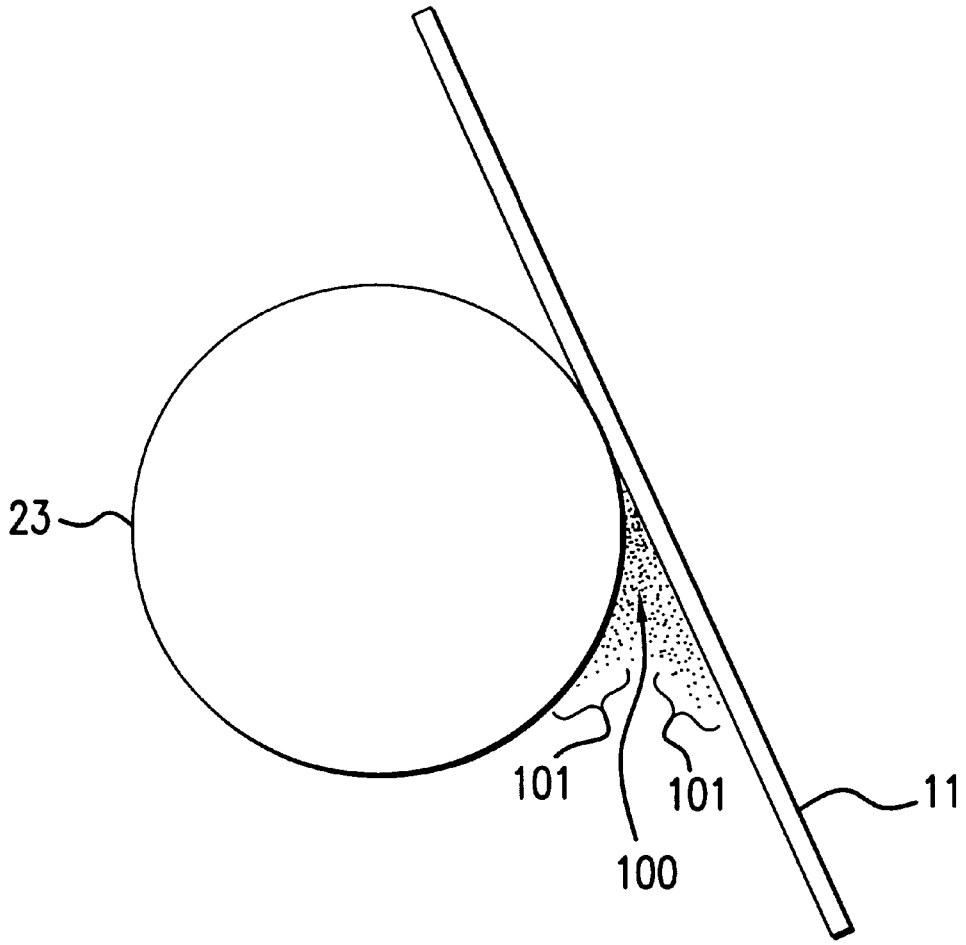
FIG. 2 is an enlarged view of the nip region of FIG. 1 between a transfer belt and a transfer belt charge roller.

Shown in FIG. 2 is a close up view of the nip region 100 between transfer belt 11 and a charging device, such as transfer belt charge roller 23. The previously mentioned transfer process which transfers toner on transfer belt 11 to print media 19, does not operate with 100% transfer efficiency. Between the transfer of toner to successive units of print media passing through electrophotographic printing system 1, the residual toner particles 101 remaining on locations on the surface of transfer belt 11 must be substantially removed prior to the transfer of toner onto those locations to prevent degradation in the print quality. The term "substantially removed" as it is used in this context refers to the removal of residual toner particles 101 to the degree that no perceptible print quality defects arise from the residual toner particles 101 which remain on transfer belt 11. If the residual toner particles 101 are not removed from transfer belt 11, they may be transferred to the next unit of print media 19 during the transfer of the toner for the next page, possibly resulting in print quality defects.

Residual toner particles 101 are removed by electrostatically moving the toner from the transfer belt 11 onto the surface of photoconductor drum 7 where cleaning blade 16 removes residual toner particles 101 and deposits them in waste hopper 17. One way to electrostatically move toner from the transfer belt 11 back to the surface of photoconductor drum 7 involves imparting a positive charge to the residual toner particles 101 remaining on the surface of transfer belt 11 and applying a positive DC voltage to first transfer roller 12. As previously mentioned, tribo-electric charging of the toner in developers 2–5 is designed to impart a negative charge to the surface of the toner particles. Using the suggested method of residual toner 101 removal requires reversing the charge polarity of much of residual toner 101.

Typically, residual toner particles 101 remaining on transfer belt 11 after the transfer process involving second transfer roller 18 are charged both positively and negatively. To effectively remove the residual toner particles 101, the polarity of the negatively charged residual toner particles 101 must be changed to positive. As transfer belt 11 passes over first transfer roller 12, the positively charged toner is repelled from a positively biased first transfer roller 12 and moves onto the surface of photoconductor drum 7 for subsequent removal by cleaning blade 16.

Transfer belt charge roller 23 is used to positively charge residual toner 101 on transfer belt 11 for subsequent removal. Initial attempts to positively charge residual toner 101 involved the application of a positive DC offset voltage to transfer belt charge roller 23. However, the application of only a positive DC offset voltage did not effectively positively charge the residual toner 101.

Consider the arrangement shown in FIG. 2 with only a positive DC offset voltage applied to the transfer belt charge roller 23. The electric field resulting from application of the positive DC offset voltage results in the movement of some of the negatively charged toner 101 from the surface of transfer belt 11 to the surface of transfer belt charge roller 23. The positive DC offset voltage applied to the transfer belt charge roller 23 results in air ionization and the movement of negative ions onto the surface of transfer belt charge roller 23 and positive ions onto the surface of transfer belt 11. The positively charged residual toner 101 residing on the surface of transfer belt 11 will become more positively charged. The negatively charged residual toner particles 101 residing on the surface of transfer belt 11 will also become more positively charged. However, those negatively charged residual toner particles 101 which moved onto the surface of transfer belt charge roller 23 will become more negatively charged as a result of the negative ions accumulating on the surface of transfer belt charge roller 23.

With a positive DC offset voltage applied to the transfer belt charge roller 23, the increasingly negatively charged residual toner 101 will remain electrostatically bound to the surface of transfer belt charge roller 23. It has been found that with the application of only a positive DC offset voltage to transfer belt charge roller 23, negatively charged residual toner 101 will continue to accumulate on the surface of transfer belt charge roller 23 over successive cycles of printing units of print media 19. Eventually, the accumulated residual toner 101 begins to fall away from the surface of transfer belt charge roller 23 resulting in toner contamination internal to electrophotographic printing system 1. Before the accumulated residual toner 101 on the surface of transfer belt charge roller 23 begins to fall away, the effectiveness of transfer belt charge roller 23 in positively charging the residual toner 101 on transfer belt 11 will have been significantly degraded. Observation of the layer of accumulated residual toner 101 on transfer belt charge roller 23 and measurement of the charge mass ratio of the residual toner charge on transfer belt 11 supports this understanding of the effects of an applied positive DC offset voltage.

Figure 3:
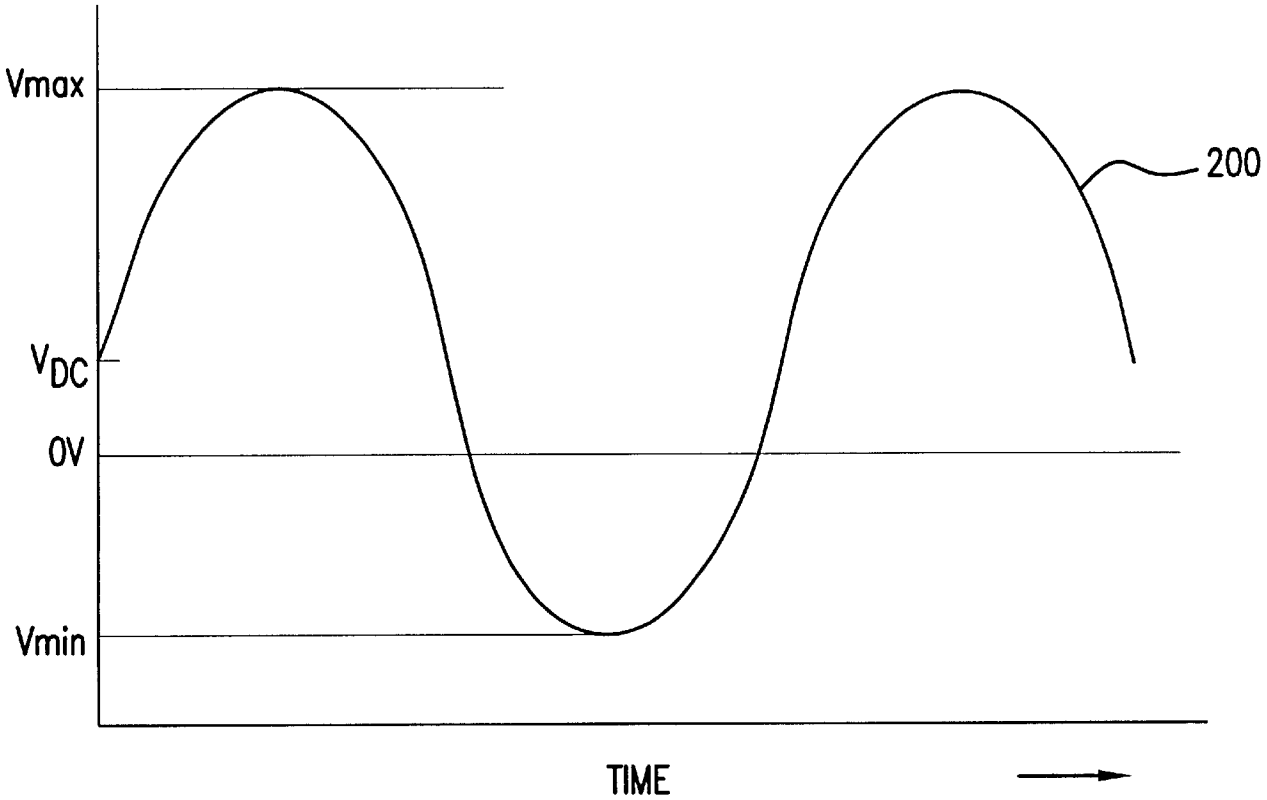
FIG. 3 is a plot of an exemplary waveform which may be applied to the transfer belt charge roller.

It was discovered that with the application of an appropriate magnitude AC waveform, in addition to the positive DC offset voltage, the residual toner 101 on transfer belt 11 assumes the positive charge level necessary for transfer to photoconductor drum 7 and residual toner 101 build up on transfer belt charge roller 23 is substantially eliminated. Shown in FIG. 3 is a plot of a typical waveform 200 which may used to drive transfer belt charge roller 23 to achieve effective positive charging of residual toner 101 while preventing residual toner 101 build up on transfer belt charge roller 23. Although the representative waveform 200 is a sinusoid superimposed upon a positive DC offset voltage, one skilled in the art would recognize by understanding this specification that a variety of AC waveshapes, such as a square wave, a sawtooth wave, or a triangle wave, superimposed upon a positive DC offset voltage may be useful for positively charging the residual toner 101 on transfer belt 11.

Values of the positive DC offset voltage and the magnitude and frequency of an applied sinusoidal waveform which would result in a residual toner 101 charge conducive to electrostatic removal for electrophotographic printing system 1 were empirically determined. A positive DC offset voltage of 550 volts when used in conjunction with a superimposed sinusoidal AC waveform having a peak to peak magnitude in the range of 2000 to 3000 volts and a frequency in the range of 1000 to 3000 hertz was found to result in substantial removal of the residual toner 101. It should be recognized that it may be possible to vary the positive DC offset voltage around the previously mentioned value and still achieve the condition in which the residual toner is substantially removed. Furthermore, it should recognized that the optimal values of the frequency and magnitude of the applied AC waveform and of the positive DC offset voltage may change depending upon the parameters of the electrophotographic process in which the toner charging system is used.

By imposing a sufficiently large magnitude AC waveform upon the positive DC offset voltage, ionization of the air occurs on both the positive and negative excursions of the applied AC waveform so that charge is deposited on residual toner 101 on both excursions. It has been determined that the magnitude of the AC waveform necessary to achieve substantial removal of residual toner 101 must be such that ionization occurs on both the positive and negative excursions of the applied AC waveform. The frequency of the applied AC waveform is greater than the rotational frequency of the transfer belt charge roller 23 so that the residual toner 101 residing on the transfer belt 11 is uniformly charged. Consider a location on the surface of transfer belt 11, containing residual toner 101, as it moves into the region prior to nip region 100 in which ionization of the air begins. When the combination of the applied AC waveform and the positive DC offset voltage biases the transfer belt charge roller 23 positive with respect to the transfer belt 11, positively charged residual toner 101 is attracted to the surface of transfer belt 11. Positive charge is deposited upon residual toner 101 on the surface of transfer belt 11. However, some negatively charged residual toner 101 moves to the surface of transfer belt charge roller 23 depending upon the image charge forces which must be overcome. When the combination of the applied AC waveform and the positive DC offset voltage biases the transfer belt 11 positive with respect to the transfer belt charge roller 23, some negatively charged residual toner 101 moves from the surface of transfer belt charge roller 23 to the surface of transfer belt 11 depending upon the image charge forces which must be overcome. At this time, negative charge is deposited upon residual toner 101 on the surface of transfer belt 11. In addition, some positively charged residual toner 101 on the surface of transfer belt 11 moves to the surface of transfer belt charge roller 23 depending on the image charge which must be overcome.

As the aforementioned location on the surface of transfer belt 11 moves through the nip region 100, positively and negatively charged residual toner moves between the surface of transfer belt 11 and the surface of transfer belt charge roller 23. Because of the positive DC offset voltage, the potential between the transfer belt charge roller 23 and the transfer belt 11 is such that a greater amount of time is spent in a condition in which positive charge is deposited onto the residual toner 101 on the surface of transfer belt 11 than in a condition in which negative charge is deposited onto the residual toner 101 on the surface of transfer belt 11. In addition, during the time in which positive charge is deposited onto the residual toner 101 on the surface of transfer belt 11, the magnitude of the average potential difference between the transfer belt charge roller 23 and the transfer belt 11 is greater than during the time in which negative charge is deposited onto the residual toner 101 on the surface of transfer belt 11. As a result, as the location on the surface of transfer belt 11 moves through nip region 100, there is a net transfer of positive charge onto the residual toner 101 on the surface of transfer belt 11. In addition, as the location moves through nip region 100, negatively charged residual toner 101 becomes positively charged by the time the location passes out of the nip region 100. Furthermore, as the location moves through the nip region 100, the image charge attracting positively charged residual toner 101 to the surface of transfer belt 11 becomes large enough to prevent movement of the positively charged residual toner 101 to the surface of the transfer belt charge roller 23.

The principle of operation of transfer belt charge roller 23 is similar to that of photoconductor charge roller 8. More detail regarding the operation of charge rollers can be found in U.S. Pat. No. 4,851,960, issued to Nakamura et al., the disclosure of which is incorporated by reference herein. It should also be noted that, as shown in FIG. 1 and FIG. 2, transfer belt charge roller 23 is located in position to positively charge residual toner on the surface of transfer belt 11. During the development of toner onto transfer belt 11 for printing, transfer belt charge roller 23 is moved away from the surface of transfer belt 11 so that the toner pile developed onto the surface of transfer belt 11 is not disrupted.

One of ordinary skill in the art would recognize from understanding this specification that a variety of electrophotographic imaging systems may incorporate the toner charging system. Electrophotographic printing systems implemented using different combinations of various types of photoconductors and toner carrying members can be used with the toner charging system. For example, an electrophotographic printing system implemented using a photoconductor belt and a transfer drum may be used with a toner charging system employing a charge roller to charge the residual toner. Or, an electrophotographic printing system having a photoconductor belt and a transfer belt may be used with a toner charging system employing another type of contact charging device to charge the residual toner.

Figure 4:
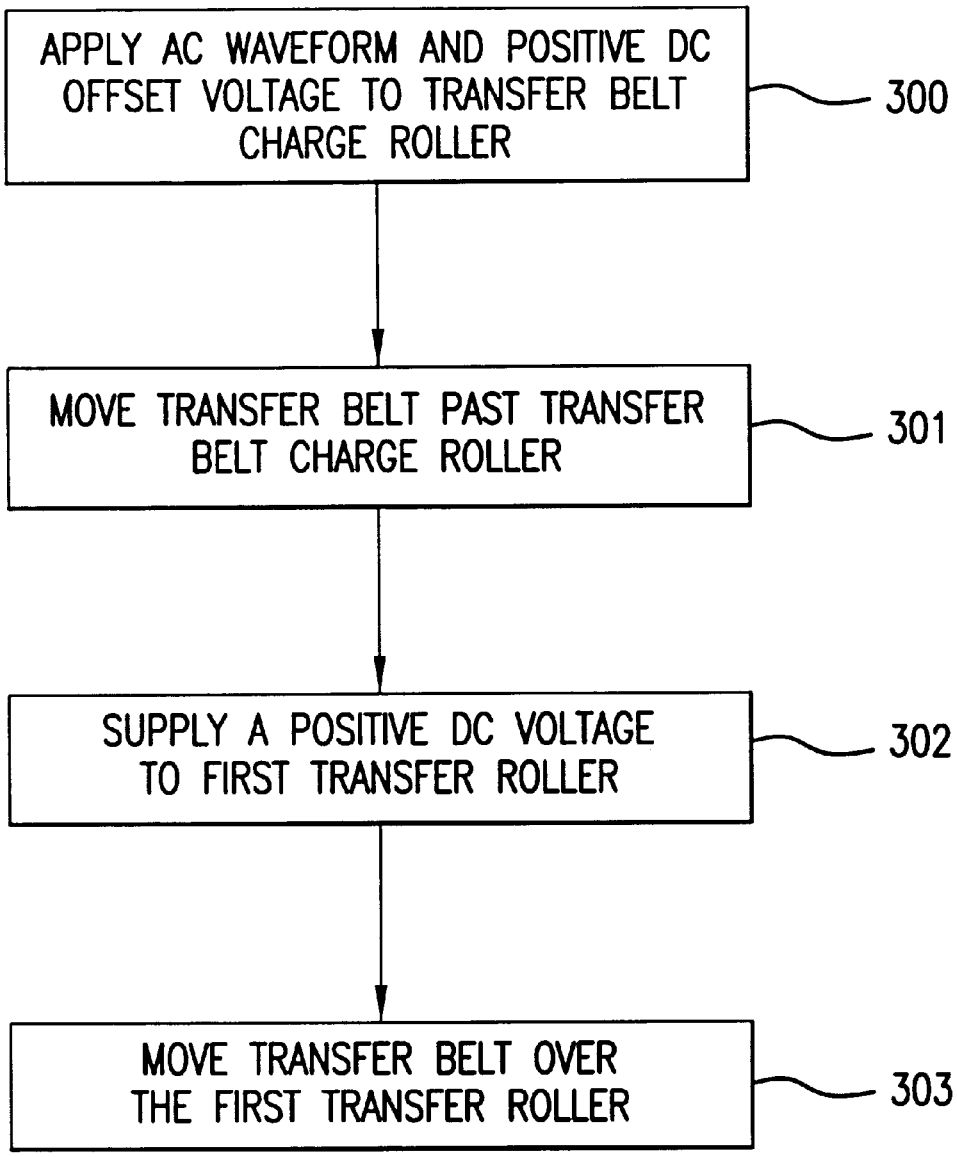
FIG. 4 is a simplified flow diagram of a method for charging toner using the disclosed embodiment of the toner charging system.

Shown in FIG. 4 is a simplified flow diagram of a method for charging residual toner 101, using the disclosed embodiment of the toner charging system, and subsequently moving residual toner 101 from transfer belt 11 to photoconductor drum 7. First, in step 300, high voltage power supply 20 applies an AC waveform, superimposed upon a positive DC offset voltage, to in step 301, transfer belt charge roller 23. Next, transfer belt 11, having residual toner 101 disposed upon its surface, moves past transfer belt charge roller 23. Then, as residual toner 101 passes through nip region 100, a net positive charge flows onto residual toner 101 from transfer belt charge roller 23. Next, in step 302, high voltage power supply 20 supplies 303 a predetermined positive DC voltage to first transfer roller 12. Finally, in step 303, transfer belt 11 moves the positively charged residual toner 101 over first transfer roller 12 which results in the positively charged residual toner 101 moving from the surface of transfer belt 11 to the surface of photoconductor drum 7.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. A toner charging system for charging toner, comprising:

a first toner carrying member having a first surface to carry said toner and having a second surface;

a charging device located opposite said first surface, said charging device for charging said toner to a polarity;

a second toner carrying member located opposite said first surface so that said first toner carrying member can move said toner on said first surface adjacent to said second toner carrying member;

a transfer device coupled to said second surface of said first toner carrying member to generate an electric field for moving said toner from said first toner carrying member onto said second toner carrying member; and a power supply coupled to said charging device to supply a first signal having an AC component and a first DC component to said charging device.

2. The toner charging system as recited in claim 1, wherein:

said first toner carrying member includes a transfer belt; and said second toner carrying member includes a photoconductor.

3. The toner charging system as recited in claim 2, wherein:

said charging device includes a charge roller.

4. The toner charging system as recited in claim 3, wherein:

said transfer device includes a transfer roller to contact said second surface adjacent said photoconductor with said transfer roller coupled to said power supply.

5. The toner charging system as recited in claim 4, wherein:

said power supply includes a configuration to provide a second signal having a second DC component to said transfer roller to positively charge said second surface; and said polarity includes a positive polarity.

6. The toner charging system as recited in claim 5, wherein:

said AC component of said first signal follows a square wave.

7. In an electrophotographic imaging system including a first toner carrying member having a first surface to carry toner and having a second surface, a charging device located opposite said first surface, a second toner carrying member located opposite said first surface, a transfer device coupled to said second surface, and a power supply coupled to said charging device, a method for removing said toner from said first surface comprising:

supplying a first signal having an AC component and a first DC component to said charging device with said power supply;

charging said toner on said first toner carrying member to a polarity with said charging device;

generating an electric field between said second toner carrying member and said first surface with said transfer device; and transferring said toner from said first surface onto said second toner carrying member.

8. The method as recited in claim 7, wherein:

said charging device includes a charge roller.

9. The method as recited in claim 8, wherein:

said first toner carrying member includes a transfer belt;

said second toner carrying member includes a photoconductor; and said transfer device includes a transfer roller coupled to said power supply, with said transfer roller for contacting said second surface adjacent to said photoconductor.

10. The method as recited in claim 9, further comprising:

supplying a second signal having a second DC component to said transfer roller with said power supply, with supplying said second signal occurring before generating said electric field; and moving said toner on said first surface of said transfer belt adjacent to said photoconductor, with moving said toner occurring before transferring said toner.

11. The method as recited in claim 10, wherein:

said first DC component and said second DC component each include a positive voltage;

generating said electric field includes positively charging said second surface with said transfer roller; and said polarity includes a positive polarity.

12. The method as recited in claim 11, wherein:

said electrophotographic imaging system includes an electrophotographic printer.

13. A system for electrophotographically forming images using toner, said system comprising:

a first toner carrying member having a first surface to carry said toner and having a second surface;

a charging device located opposite said first surface, said charging device for charging said toner to a polarity;

a second toner carrying member located opposite said first surface so that said first toner carrying member can move said toner on said first surface adjacent to said second toner carrying member;

a transfer device coupled to said second surface of said first toner carrying member to generate an electric field for moving said toner from said first toner carrying member onto said second toner carrying member; and a power supply coupled to said charging device to supply a first signal having an AC component and a first DC component.

14. The system as recited in claim 13, wherein:

said system includes an electrophotographic printing system.

15. The system as recited in claim 14, wherein:

said first toner carrying member includes a transfer belt; and said second toner carrying member includes a photoconductor.

16. The system as recited in claim 15, wherein:

said charging device includes a charge roller.

17. The system as recited in claim 16, wherein:

said transfer device includes a transfer roller to contact said second surface with said transfer roller coupled to said power supply;

said power supply includes a configuration to provide a second signal having a second DC component to said transfer roller to positively charge said second surface; and said polarity includes a positive polarity.

* * * * *